US009485578B2

(12) United States Patent
Terrell et al.

(10) Patent No.: US 9,485,578 B2
(45) Date of Patent: Nov. 1, 2016

(54) AUDIO FORMAT

(71) Applicant: Queen Mary University of London, London (GB)

(72) Inventors: Michael Terrell, London (GB); Andrew Simpson, London (GB)

(73) Assignee: Queen Mary University of London, London (GB)

( * ) Notice: Subject to any disclaimer, the term of this patent is extended or adjusted under 35 U.S.C. 154(b) by 0 days.

(21) Appl. No.: 14/106,550

(22) Filed: Dec. 13, 2013

(65) Prior Publication Data

US 2014/0169573 A1 Jun. 19, 2014

Related U.S. Application Data

(60) Provisional application No. 61/737,441, filed on Dec. 14, 2012.

(51) Int. Cl.
*H04R 3/04* (2006.01)

(52) U.S. Cl.
CPC ..... *H04R 3/04* (2013.01)

(58) Field of Classification Search
None
See application file for complete search history.

(56) References Cited

U.S. PATENT DOCUMENTS

| | | | | |
|---|---|---|---|---|
| 5,111,506 | A * | 5/1992 | Charpentier et al. | 381/320 |
| 5,289,544 | A * | 2/1994 | Franklin | 381/313 |
| 2002/0191802 | A1* | 12/2002 | Choe et al. | 381/92 |
| 2003/0210798 | A1* | 11/2003 | Ohyaba | 381/96 |
| 2004/0170288 | A1* | 9/2004 | Maeda | 381/86 |
| 2012/0014541 | A1* | 1/2012 | Nakayama et al. | 381/111 |
| 2013/0279738 | A1* | 10/2013 | Daley | 381/423 |
| 2013/0336490 | A1* | 12/2013 | Someda | 381/17 |
| 2014/0169573 | A1* | 6/2014 | Terrel et al. | 381/58 |

OTHER PUBLICATIONS

Lartillot, O. et al., "A Matlab Toolbox for Music Information Retrieval", in Data Analysis, Machine Learning and Applications, Springer Berlin Heidelberg, (month unknown) 2008, pp. 261-268.
Anstis et al., "Adaptation to Auditory Streaming of Frequency-Modulated Tones" In Journal of Experimental Psychology: Human Perception and Performance, vol. 11, No. 3, Jun. 1985, pp. 257-271.
Barchiesi et al., "Reverse Engineering of a Mix" In Journal of the Audio Engineering Society, vol. 58, No. 7/8, Jul./Aug. 2010, pp. 563-576.

(Continued)

*Primary Examiner* — Peter Vincent Agustin
(74) *Attorney, Agent, or Firm* — Byrne Poh LLP

(57) ABSTRACT

Mechanisms for obtaining an audio signal and information relating to the recording conditions of the audio signal are provided, the method comprising: obtaining an audio signal, wherein the audio signal is a voltage signal representation of sound, the voltage signal having been converted from a pressure signal; obtaining first information indicative of at least one objective feature and/or at least one perceptual feature associated with the conversion of the pressure signal into the audio signal in the form of a voltage signal representation; storing the audio signal, the first information, and second information identifying a relationship between the audio signal and the first information; determining an error adjustment for adjusting the audio signal based on the obtained information; applying the error adjustment to the audio signal to create an error-adjusted audio signal; and obtaining an audio signal and information relating to the recording conditions of the audio signal.

1 Claim, 3 Drawing Sheets

(56) References Cited

OTHER PUBLICATIONS

Bregman, A. S., "Auditory Streaming is Cumulative", Journal of Experimental Psychology. Human Perception and Performance, vol. 4, No. 3, Aug. 1978, pp. 380-387.
Dugan, Dan, "Application of Automatic Mixing Techniques to Audio Consoles", In Proceedings of the 87th International Convention of the Audio Engineering Society, New York, NY, US, Oct. 1, 1989, pp. 1-18.
Dugan, Dan, "Automatic Microphone Mixing.",In Proceedings of the 51st International Convention of the Audio Engineering Society, Los Angeles, CA, US, May 1, 1975, pp. 1-32.
Fletcher et al., "Loudness, its Definition, Measurement, and Calculation" in the Journal of the Acoustical Society of America, vol. 5, No. 2, Oct. 1933, pp. 82-108.
Glasberg et al., " A Model of Loudness Applicable to Time-Varying Sounds" In Journal of Audio Engineering Society, vol. 50, No. 5, May 2002, pp. 331-342.
Gonzales et al., "Automatic Equalization of Multi-Channel Audio Using Cross-Adaptive Methods", In Proceedings of the 127th International Convention of the Audio Engineering Society, New York, NY, US, Oct. 9-12, 2009, pp. 1-6.
Gonzalez et al., "A Real-Time Semi-Autonomous Audio Panning System for Music Mixing." in EURASIP Journal on Advances in Signal Processing, vol. 2010, No. 1, May 26, 2010, pp. 1-10.
Gonzalez et al., "An Automatic Maximum Gain Normalization Technique with Applications to Audio Mixing.", in Proceedings of the 124th International Convention of the Audio Engineering Society, Amsterdam, Netherlands, May 1, 2008, pp. 1-8.
Gonzalez et al., "Automatic Gain and Fader Control for Live Mixing", in Proceedings of IEEE Workshop on Applications of Signal Processing to Audio and Acoustics, New Paltz, NY, US, Oct. 18-21, 2009, pp. 1-4.
Gonzalez et al., "Automatic Mixing: Live Downmixing Stereo Panner", In Proceedings of the 10th Int. Conference on Digital Audio Effects, Bordeaux, France, Sep. 10-15, 2007, pp. 1-6.
Haywood et al., "Effects of Inducer Continuity on Auditory Stream Segregation: Comparison of Physical and Perceived Continuity in Different Contexts" In The Journal of the Acoustical Society of America, vol. 130, No. 5, Oct. 2011, pp. 2917-2927.
Kolasinski, B. A., "A Framework for Automatic Mixing Using Timbral Similarity Measures and Genetic Optimization." In Proceedings of the 124th International Convention of the Audio Engineering Society, Amsterdam, Netherlands, May 1, 2008, pp. 1-8.
Lorenzi et al., "Speech Perception Problems of the Hearing Impaired Reflect Inability to Use Temporal Fine Structure" In Proceedings of the National Academy of Sciences of the United States of America, vol. 103, No. 49., Dec. 5, 2006, pp. 18866-18869.
Miller, G. A., "Sensitivity to Changes in the Intensity of White Noise and its Relation to Masking and Loudness" In the Journal of the Acoustical Society of America, vol. 19, No. 4, Jul. 1947, pp. 609-619.
Moore et al., "A Model for the Prediction of Thresholds, Loudness, and Partial Loudness", In Journal of Audio Engineering Society, vol. 45, No. 4, Apr. 1997, pp. 224-240.
Moore et al., "Factors Influencing Sequential Stream Segregation" in Acta Acustica United with Acustica, vol. 88, No. 3, May/Jun. 2002, pp. 320-333.
Moore et al., "Pure-Tone Intensity Discrimination: Some Experiments Relating to the 'Near-Miss' to Weber's Law" In the Journal of the Acoustical Society of America, vol. 55, No. 5, May, 1974, pp. 1049-1054.
Pienkowski et al., "Auditory Intensity Discrimination as a Function of Level-Rove and Tone Duration in Normal-Hearing and Impaired Subjects: the 'Mid Level Hump' Revisited", In Hearing Research, vol. 253, No. 1-2, Jul. 2009, pp. 107-115.
Scharf B., "Partial Masking", In Acta Acustica United with Acustica, vol. 14, No. 1, Jan. 1, 1964, pp. 16-23.
Scharf et al. "On the Relation Between the Growth of Loudness and the Discrimination of Intensity for Pure Tones", In the Journal of the Acoustical Society of America, vol. 82, No. 2, Aug., 1987, pp. 448-453.
Terell et al., "Automatic Montior Mixing for Live Musical Performance", In Journal of the Audio Engineering Society, vol. 57, No. 11, Nov. 1, 2009, pp. 927-936.
Terrell et al., "A Format and System for Sound Transmission Error Estimation and Correction"Technical Report, Queen Mary University of London, Dec. 2, 2011, pp. 1-7.
Terrell et al., "A Perceptual Audio Mixing Device" in Proceedings of the 134th International Convention of the Audio Engineering Society, Rome, Italy, May, 2013, pp. 1-9.
Terrell et al., "An Offline, Automatic Mixing Method for Live Music, Incorporating Multiple Sources, Loudspeakers, and Room Effects", in Computer Music Journal, vol. 36, No. 2, May 14, 2012, pp. 37-54.
Terrell et al., "Sounds not Signals: A Perceptual Audio Format", In Proceedings of the 132nd Convention of the Audio Engineering Society, Budapest, Hungary, Apr. 26-29, 2012, pp. 1-5.
Zeng et al., "Intensity Discrimination in Forward Masking" In The Journal of the Acoustical Society of America, vol. 92, No. 2 pt. 1, Aug. 1992, pp. 782-787.

* cited by examiner

AUDIO FORMAT

CROSS REFERENCE TO RELATED APPLICATION

This application claims the benefit of U.S. Provisional Patent Application No. 61/737,441, filed Dec. 14, 2012, which is hereby incorporated by reference herein in its entirety.

BACKGROUND

The process of transmitting sounds from the initial capture to consumption can be summarised by four stages:

1. Capture. Acoustic signals are captured and converted into voltage representations and are stored on a (typically) digital media as digital audio signals, typically via a microphone.
2. Production. Digital audio signals are combined, and processed using a range of tools to produce a final "mix" that fulfils a range of functional and aesthetic objectives, e.g. a musical project with involved combining audio signals recorded from multiple instruments and the final mix is stored as a stereo audio signal, and the sound production stages of a film project would involve combining the dialogue, sound effects and sound track as a 5.1 audio signal. This process is undertaken in a dedicated production studio, key components of which are a sound treated room and high quality loudspeakers.
3. Transmission. The final mix (i.e. the audio signal) is transmitted to the consumer, as a broadcast signal (e.g. television), as physical media (e.g. compact disk), or as digital media (e.g. mp3 download).
4. Consumption. Consumers listen to the transmission by playing back the audio signal on a suitable reproduction system, e.g. home stereo, personal mp3 player, or cinema.

Live transmissions—which includes telecommunication—follow an equivalent process, however the production process and transmission stages occur in real-time alongside the capture.

Techniques to improve audio transmission have generally focussed on preserving the fidelity of the audio signal through the transmission process. An early example of this was the use of digital encoding and processing of trans-Atlantic telephone communication, which dramatically reduced the inevitable noise introduced on long distance lines. Focus in more recent years has been on ways to compress the data transmission rate, whilst allowing for "loss-less" reconstruction of the original audio signal. Manufacturers of sound systems strive to produce amplifiers and loudspeakers that produce acoustic signals that are true representations of the transmitted audio signal (i.e. linearly scaled versions). In addition, others have developed a means to automatically equalise the audio signal to mitigate the effect that the sound system may have on the frequency spectrum of the reproduced sound. There is therefore always room for improving different parts of the process of capturing, producing, transmitting and consuming sounds. None of these parts have yet been perfected and the attempts to improve these different parts of the process usually result in some compromise, particularly when it comes to the final sound quality at the sound consumption stage.

SUMMARY

In accordance with an aspect of the invention there is provided a method for obtaining an audio signal and information relating to the recording conditions of the audio signal. The method comprises obtaining an audio signal, wherein the audio signal is a voltage signal representation of sound, the voltage signal having been converted from a pressure signal, obtaining information indicative of at least one objective feature and/or at least one perceptual feature associated with the conversion of the pressure signal into the audio signal in the form of a voltage signal representation, and storing the audio signal, the information indicative of objective features and/or perceptual features, and information identifying a relationship between the audio signal and the information indicative of the at least one objective feature and/or the at least one perceptual feature.

The information indicative of the at least one objective feature and/or the at least one perceptual feature may comprise the at least one objective feature and/or the at least one perceptual feature.

The information indicative of the at least one objective feature and/or the at least one perceptual feature may comprise a transfer function.

The at least one objective feature may be extracted from absolute pressure signals of the audio signal.

The at least one objective feature may be obtained from the RMS or peak intensity of the pressure signal or from the peak sound pressure level of the pressure signal.

The at least one perceptual feature may be determined using one or more auditory models. The one or more auditory models may use psychoacoustic techniques.

Each objective and/or perceptual feature may have an associated weighting.

Obtaining the audio signal may comprise converting a pressure signal to a voltage signal.

The storing of the audio signal, the information indicative of the at least one objective feature and/or the at least one perceptual feature, and information identifying a relationship between the audio signal and the information indicative of the at least one objective feature and/or the at least one perceptual feature may comprise creating an audio file comprising the audio signal and the information indicative of the at least one objective feature and/or the at least one perceptual feature. The method may further comprise transmitting the audio file.

The audio file may comprise a plurality of associated audio signals, each audio signal corresponding to an associated audio track, wherein each audio track has associated information indicative of the at least one objective feature and/or the at least one perceptual feature.

The method may further comprise providing error bounds defining a maximum and minimum allowable error in reproduction of the audio signal.

According to another aspect of the invention there is provided apparatus for obtaining an audio signal and information relating to the recording conditions of the audio signal. The apparatus comprises a processor arranged to perform the method described above. The apparatus also comprises a memory in which the audio signal, the information indicative of the at least one objective feature and/or the at least one perceptual feature, and information identifying a relationship between the audio signal and the information indicative of the at least one objective feature and/or the at least one perceptual feature are stored.

According to yet another aspect of the invention a computer readable medium comprising computer readable code operable, in use, to instruct a computer system to perform the method described above is provided.

According to a further aspect of the invention there is provided a file for providing a data representation of recorded sound, the file comprising an audio signal, wherein the audio signal is a voltage signal representation of sound, the voltage signal having been converted from a pressure signal, and information indicative of the at least one objective feature and/or the at least one perceptual feature.

The information indicative of the at least one objective feature and/or the at least one perceptual feature may comprise the at least one objective feature and/or the at least one perceptual feature.

Information indicative of the at least one objective feature and/or the at least one perceptual feature may comprise a transfer function.

The at least one objective feature may be extracted from absolute pressure signals of the audio signal.

The at least one objective feature may be obtained from the RMS peak intensity of the pressure signal or from the peak sound pressure level of the pressure signal.

The at least one objective feature may be a function of a scaled pressure signal.

The at least one perceptual feature may be determined using one or more auditory models. The one or more auditory models may use psychoacoustic techniques.

Each objective and/or perceptual feature may have an associated weighting.

Obtaining the audio signal may comprise converting a pressure signal to a voltage signal.

The obtained information indicative of the at least one objective error and/or the at least one perceptual error may comprise error bounds defining a maximum and a minimum allowable error.

The file may comprise a plurality of associated audio signals, each audio signal corresponding to an associated audio track, wherein each audio track has associated information indicative of the at least one objective feature and/or the at least one perceptual feature.

According to another aspect of the invention a method for processing an audio signal for playing is provided, the method comprising obtaining an audio signal, wherein the audio signal is a voltage signal representation of sound, the voltage signal having been converted from a pressure signal, obtaining first information indicative of at least one objective feature and/or at least one perceptual feature associated with the conversion of the pressure signal into the audio signal in the form of a voltage signal representation, obtaining second information indicative of at least one objective feature and/or at least one perceptual features associated with the conversion of the audio signal in the form of a voltage signal representation into a pressure signal, determining an error adjustment for adjusting the audio signal based on the obtained information, and applying the error adjustment to the audio signal to create an error-adjusted audio signal.

The method may further comprise playing the error-adjusted audio signal.

The method may further comprise detecting a sound that could result in hearing impairment of a listener of the error-adjusted audio signal, and varying the error adjustment to compensate for the potential hearing impairment of the listener.

The error adjustment may be determined by comparing the first information with the second information.

One or more of the first information, the second information, or an error adjustment may be graphically represented to a user.

The first information may comprise the at least one objective feature and/or the at least one perceptual feature.

The first information may comprise a transfer function.

The at least one objective feature of the first information may be extracted from absolute pressure signals of the audio signal.

The at least one objective feature of the first information may be obtained from the RMS or peak intensity of the pressure signal or from the peak sound pressure level.

The at least one objective feature of the first information may be a function of a scaled pressure signal.

The at least one perceptual feature of the first information may be determined using one or more auditory models. The one or more auditory models may use psychoacoustic techniques.

Each objective and/or perceptual error may have an associated weighting.

The first information may comprise error bounds defining a maximum and minimum allowable error in the conversion of the audio signal to a pressure signal.

The method may further comprise determining if the error adjustment results in the signal being within the error bounds, if the signal is not within the error bounds then the method further comprises providing a warning.

The method may further comprise receiving a file comprising the audio signal and the first information.

The file may comprise a plurality of associated audio signals, each audio signal corresponding to an associated audio track, wherein each audio track has associated information indicative of the at least one objective feature and/or the at least one perceptual feature.

Obtaining the second information may comprise determining characteristics of one or more of: a system arranged to play the audio; an environment in which the system is arranged to play the audio; and a listener. The characteristics of the environment may include background noise.

According to yet a further aspect of the invention there is provided apparatus for processing an audio signal for playing, the apparatus comprising a processor arranged to perform the method described above, and a memory arranged to store the error-adjusted audio signal created according to the method.

According another aspect of the invention there is provided a computer readable medium comprising computer readable code operable, in use, to instruct a computer system to perform the method described above.

BRIEF DESCRIPTION OF THE DRAWINGS

Exemplary embodiments of the invention shall now be described with reference to the drawings in which.

Throughout the description and the drawings, like reference numerals refer to like parts.

DETAILED DESCRIPTION

Figure 1:
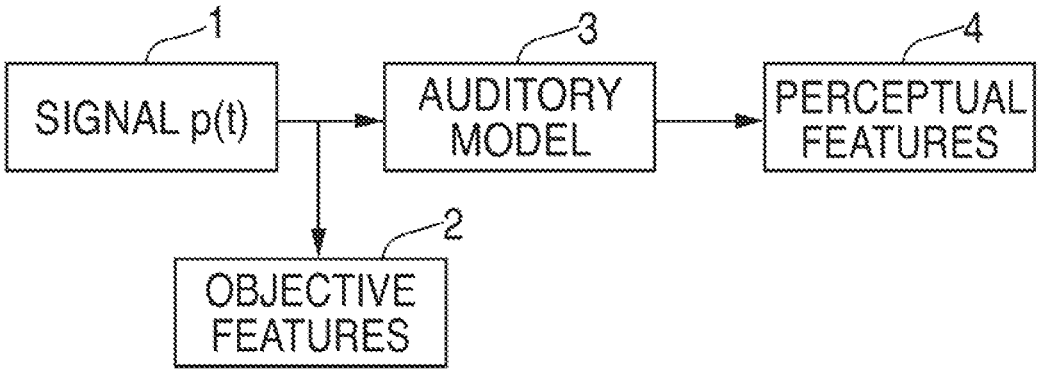
FIG. 1 provides a flow diagram of how features of the audio format are obtained.

In communication theory a signal is transmitted from a source to a receiver. The difference between the source and receiver signals is the transmission error. When dealing with sounds the signals are in the pressure domain so the transmission error must be evaluated based on the difference between the source and receiver pressure signals. The acoustic pressure fluctuations of a sound deflect the ear drum. The deflection of the ear drum causes the middle ear ossicles (bones) to amplify and transmit this deflection to the inner ear (cochlea) via the oval window, which imposes a changing pressure on the internal fluid of the cochlea. The pressure variation inside the fluid of the cochlea causes localised resonance on the basilar membrane. Hair cells located on the basilar membrane transduce this resonant excitation, via shearing of the hair cells, into variation in receptor potential, which is then further transduced by neurons connected to the hair cells. The neurons fire spontaneously at a nominal, low rate when inactive, and increase their firing rate as a function of the basilar membrane excitation. Thus the signal is transformed into frequency selective energy signals which are available for the central nervous system to process. These signals are decoded by the brain, and form the basis of our perception of the sound. In summary, the auditory system is essentially a pressure transducer, with a specific sensitivity function, which is non-linear with respect to the amplitude and frequency of the pressure signal.

The audio format disclosed herein is based on the principle and assumption that the sounds transmitted using an audio format are intended to be perceived. Therefore, when considering the error of a sound transmission system, it is important to understand the perceptual errors of the sound transmissions system as well as the objective errors, which are functions of a scaled pressure signal. In state of the art systems for sound transmission, transducers which convert the source pressure to voltage before transmission are used, in addition to voltage to pressure for reproduction (typically using a microphone and loudspeaker). Each transducer has a specific sensitivity given by, $$V_s=k_s p_s, \tag{1}$$

$$p_r=k_r V_r. \tag{2}$$

In general, ks and kr are not stored, transmitted or even known, so evaluating the transmission error in the pressure domain is impossible. It is worth noting that ks and kr may be functions rather than simple scalar constants.

Since ks and kr are unknown in state of the art systems, sound is represented as an un-scaled signal in the voltage domain. This precludes the estimation of meaningful perceptual features.

The system is based on the principle that a sound can be described in terms of objective and perceptual features. Objective features are calculated directly from the pressure signal e.g. the RMS intensity or the peak sound pressure level (SPL). Perceptual features are estimated based on the output of an auditory model. The auditory models used for the estimation of the derived perceptual features take inspiration from techniques developed in the field of psychoacoustics. For example, there are various perceptual models that are well-known. Loudness is the most widely researched perceptual feature and is defined as the perceived intensity of a sound. This is quite different to its actual intensity, which is an objective feature and is a measure its power. For sounds presented simultaneously the psychoacoustic concepts of masking and partial loudness become important. Masking describes the phenomena by which the perceived loudness of a sound is reduced when heard in the presence of other sounds. Partial loudness is the perceived intensity of a sound when heard in the presence of other sounds, but which are perceptually separable. Psychoacoustics provides several other perceptual features that may be estimated according to the output from an auditory model, for example intelligibility, timbre, pitch, etc.

The system disclosed herein measures, stores and transmits the transducer parameters along with the sound signals. This enable both objective and perceptual transmission errors to be measured and estimated reliably, from the scaled pressure signal. This novel audio format and system shall now be discussed in detail with reference to FIG. 1, which shows a flow diagram of how the features of the format are obtained.

The system works by estimating the objective and perceptual errors that are introduced by a sound transmission system by comparing sound features of the source and receiver signals. The approach involves i) the use of the absolute pressure signals 1 (as opposed to un-scaled voltage signals) from which objective sound features 2 can be extracted, and ii) the use of auditory models 3 to estimate an arbitrary number of perceptual sound features 4, as shown in FIG. 1. From this we will evaluate the objective and perceptual quality of the sound transmission system.

An objectively perfect transmission is one where the exact pressure signal of the source is recreated at the receiver location. A perceptually perfect transmission is one where the intended perceptual features are exactly those perceived at the receiver location. The sets of objective and perceptual errors in a transmission are denoted by E(p) and E(ξ) respectively.

Figure 2:
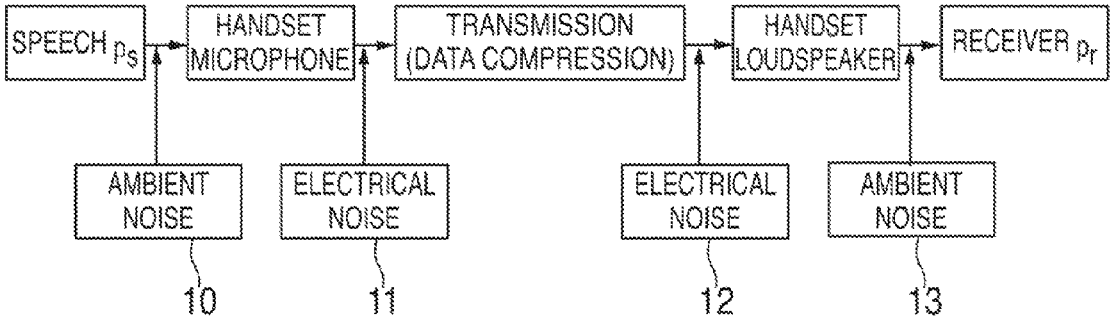
FIG. 2 illustrates the process of evaluating signal error in a simple mobile telecommunication system.

The evaluation of error is illustrated using a simple mobile telecommunication example illustrated in FIG. 2. The error in the transmission, caused by the transducers, the data compression and the different forms of noise, is evaluated by comparing objective and perceptual features of source pressure ps and receiver pressure pr. If the functions used to calculate the objective features and estimate the perceptual features are given by f(p) and g(p) respectively then, $$E(p)=f(p_s)-f(p_r), \tag{3}$$

and $$E(\xi)=g(p_s)-g(p_r). \tag{4}$$

For the case of a mobile phone, an objective feature calculated using f(p) might be the RMS SPL, and a perceptual feature estimated using g(p) might be the intelligibility of the speech. The total error in the transmission would be described in terms of an arbitrarily weighted combination of all objective and perceptual feature errors. In FIG. 2, these errors are first ambient noise 10, first electrical noise 11, second electrical noise 12, and second ambient noise 13.

Figure 3:
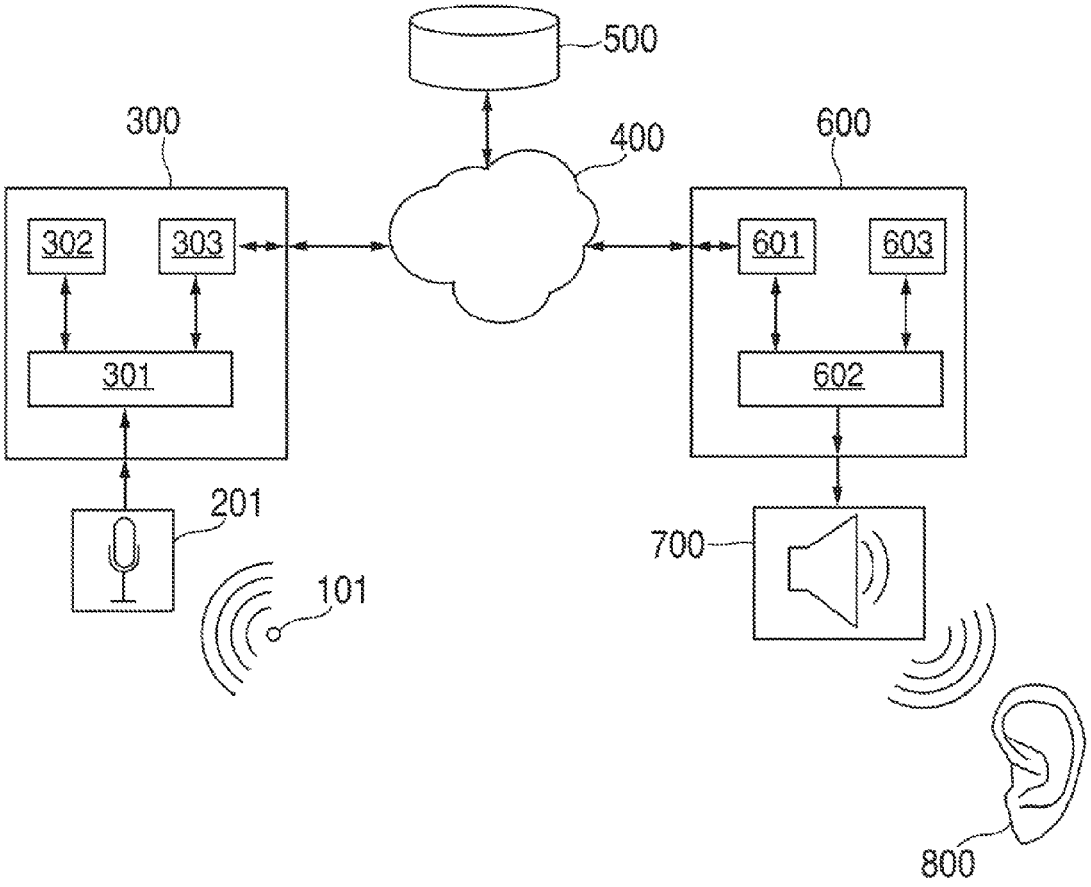
FIG. 3 shows a system in which the audio format is used for transmitting information between a number of networked devices.

In practice, the audio format system disclosed herein works as will now be described with reference to FIG. 3. Firstly, an audio signal is obtained. In this case microphone 201 records a sound from sound source 101. A recording system 300 then receives the signal from the microphone at its hardware processor 301 and stores this signal in memory 302. In this case the author of the sound signal to be transmitted (i.e. the recently recorded sound) specifies the permitted errors in E(p) and E(ξ) that define the bounds within which the reproduced signal is considered acceptable. In alternative arrangements the manufacturer of a sound transmission system may pre-specify these values. This allows the author or manufacturer to make an informed decision as to the importance of transmission errors. These tolerances are stored in memory 302. The processor 301 then packages the recorded audio with the tolerance information, which can then also be stored in memory 302, transmitted via network 400 to be stored in server 500, the server being remotely accessible by a number of users, or transmitted via network 400 to a specific user system 600.

When the user system 600 receives the audio package comprising the sound signal and the tolerance information through its communications unit 601, the hardware processor 602 can then store this package in memory 603. The tolerance information transmitted with the sound signal is then available to the user system 600 and will be available to validate the reproduction, i.e. if, $$E(p)<E(p)_{Tol}, \tag{5}$$

and, $$E(\xi)<E(\xi)_{Tol}, \tag{6}$$

then the reproduction is valid, where $E(p)_{Tol}$ and $E(\xi)_{Tol}$ are the allowable tolerances in objective and perceptual features respectively. This forms the basis of a proprietary format for sound transmission. Where multi-plex (simultaneous, bi-directional) transmission is applicable, (i.e., where each source is also a receiver), the objective and perceptual error signals shall be transmitted back to each source. Thus both parties are aware of the transmission errors from either end. This is particularly beneficial in communication system so that the transmitter knows the errors in the received signal.

At the user system 600, which is not only the system being used to play the sound, but also the room or environment in which the sound is played, pre-processing is carried out by the processor 602 prior to playing the audio in order to minimise objective and perceptual errors. In particular, optimisation algorithms are employed, which minimise the objective and perceptual errors at the receiver location by adjusting an arbitrary number of control parameters of the reproduction system such as gain, equalisation and dynamics.

The objective of this pre-processing is to reduce the errors to within the predefined tolerances. The system not only uses the tolerance values received as part of the received audio package, but also uses tolerances associated with its own system for reproduction of the sound that are stored in memory 603. In particular, a comparison of these parameters is carried out. In some systems the "correct" sound cannot be reproduced, i.e. one cannot provide a sound that is within the predefined tolerances provided at the transmitter end. As such the system playing the sound can instead evaluate its own tolerances for a given transmission. This provides a way to rate a system by its own tolerance that can be compared to that intended by the author. In other words, the combined tolerance of the playing system can be compared to the allowable tolerance for a "correct" recording that accompanies the transmission.

For example, the tolerances of the user system 600 may include characteristics of the speaker 700 that is used for reproducing the sound, as well as the environment in which the speaker 700 and listener 800 are located.

The audio format shall now be considered in the context of music production.

People listen to music in a number of different environments, from expensive loudspeakers in a quiet room to low quality headphones on a noisy underground train line. It is likely that the music will have been produced in a professional recording studio. Due to the disparity with the end user listening conditions, it will be impossible to recreate objective features of the sounds, i.e. the objective error is inevitably large.

Music signals are generally a mixture of simultaneous sounds and a key perceptual feature is the balance between these sounds. The balance, between an arbitrary number of perceptual features, may be extracted (estimated) from the finished production and transmitted along with a multitrack version of the music (or speech). Perceptual error correction can be used to reconstitute the mix from the multitrack components at the receiver location so that the perceptual balance is preserved. This is particularly important for changes in listening level and for masking effect of background noise.

An example is now presented where a mix is described of a multi-track recording of an unsigned band using the relative loudness of each instrument (loudness ratios).

A studio mix is produced using a digital audio workstation. By monitoring the listening level, the perceptual features that describe the mix are estimated. The studio mix is then reproduced at different listening levels and in different virtual environments. The listening conditions are: (i) living room; low level, room impulse response (RIR) applied representative of a small room, slight reduction in low frequency response to represent television loudspeakers, (ii) large venue; high level, RIR applied representative of a large, reverberant space, (iii) car; medium level, RIR applied representative of a typical in-car environment, road noise added.

TABLE 1

Loudness ratios of the mix of components at different listening levels and in different virtual environments

| Condition | Peak Intensity (dB SPL) | Voice (dB sone) | Guitar (dB sone) | Bass (dB sone) | Kick (dB sone) | Snare (dB sone) | Hi-Hats (dB sone) | Cymbal (dB sone) |
|---|---|---|---|---|---|---|---|---|
| Studio | 94 | 6.7 | −1.8 | −7.7 | −8.4 | 0.3 | 2.6 | 8.3 |
| Living Room | 88 | 9.2 | 4.8 | −7.1 | −11.2 | 4.0 | −3.6 | 3.9 |
| Large Venue | 106 | 4.1 | −2.3 | −5.3 | 4.7 | −5.7 | 0.8 | 3.7 |
| Car (with noise) | 100 | 8.3 | −1.1 | −9.7 | −16.2 | 2.7 | 5.5 | 10.7 |

Table 1 shows the estimated loudness ratios of the component instruments of the mix for each listening condition. The perceptual error, as defined by our format, is the difference between the studio features and the features for each condition, i.e. the studio features are held in g(ps), the features for the other conditions in g(pr), and the error is calculates using Eqn. 4. The errors ($E(\xi)$) are shown in Table 2.

TABLE 2

Loudness ratio errors with respect to the studio mix, at different listening levels and in different virtual environments.

| Condition | Peak Intensity (dB SPL) | Voice (dB sone) | Guitar (dB sone) | Bass (dB sone) | Kick (dB sone) | Snare (dB sone) | Hi-Hats (dB sone) | Cymbal (dB sone) |
|---|---|---|---|---|---|---|---|---|
| Living Room | 88 | 2.5 | 6.6 | 0.6 | −2.7 | 3.7 | −6.2 | −4.4 |
| Large Venue | 106 | −2.6 | −0.5 | 2.3 | 13.2 | −6.0 | −1.9 | −4.6 |
| Car (with noise) | 100 | 1.6 | 0.7 | −2.1 | −7.8 | 2.4 | 2.9 | 2.4 |

Using the novel audio formatting system disclosed herein, an optimization algorithm is used to minimize the transmission errors introduced when the studio mix is reproduced at different levels, and in different virtual environments. The parameters in the optimization algorithm are signal gain controls applied to each instrument in the mix. The gain controls that minimize the errors are shown in Table 3.

TABLE 3

Channel gain required to preserve the loudness ratios, estimated from the studio recording, at different listening levels and in different virtual environments.

| Condition | Peak Intensity (dB SPL) | Voice (dB sone) | Guitar (dB sone) | Bass (dB sone) | Kick (dB sone) | Snare (dB sone) | Hi-Hats (dB sone) | Cymbal (dB sone) |
|---|---|---|---|---|---|---|---|---|
| Living Room | 88 | −1.6 | −4.1 | 0.9 | 5.9 | −2.0 | 9.0 | 9.0 |
| Large Venue | 106 | 3.0 | 0.4 | −1.9 | −7.8 | 4.0 | 3.4 | 6.7 |
| Car (with noise) | 100 | −0.4 | 0.5 | 3.0 | 8.1 | −0.7 | −2.4 | −1.8 |

In all cases the residual perceptual errors are less than 0.01 dB sone. Inclusion of a maximum allowable error corresponds with the tolerances described by Equation 6.

There are many other applications in which the novel audio format disclosed herein could be used. These applications shall now discussed. Hereinafter reference is made to objective error (OE), perceptual error (PE), objective error correction (OEP) and perceptual error correction (PEC).

Civilian Telecommunication

A trans-Atlantic phone call is received regarding an important business deal. The recipient cannot afford to miss a word but the conversation occurs while he is travelling in a taxi and the signal breaks down intermittently. Since both parties are transmitting and receiving, both receive a warning that both source and receiver PE is very high, thus they agree to reschedule the call over a land line (which they know has a lower PE than the international mobile network).

Later that day the recipient listens to an answer phone message. Halfway through the message, a noisy train passes nearby. The microphone built into his phone picks up the acoustic interference (noise) and alerts him to it whilst automatically correcting for the PE. The recipient hardly notices the PE light and misses none of the message. On a subsequent occasion the background noise, and the resultant PE, is too high to correct, so the system automatically alerts the recipient that part of the message may have been missed and offers a repeat playback. Hence, the system is able to correct the signal when possible, but if correction is not possible the system is able to provide a warning of the possible error to a user.

Military Communication

A soldier on the battlefield needs to communicate with the commanding officer who is in a jeep five miles away. The enemy is hidden close at hand so the soldier must speak quietly. While he is transmitting he is provided with feedback on the PE at the receiver end. The commander is in a noisy jeep as he receives the whispered message. His PEC engages and corrects for the masking of the whispered message by the road noise. His error system shows no PE and this signal is relayed to the whispering soldier so both parties have confidence that their messages have been received and understood.

Furthermore, after the soldier has engaged the enemy, firing several rounds, his hearing system undergoes a temporary threshold shift i.e. he is temporarily hearing-impaired. The gunshots are noted by his system and the auditory model is adapted to simulate short term hearing loss. PEC corrects for this and he has no issues in understanding subsequent communication. The system is therefore able to detect noises that could result in short term hearing loss. Then, the system is able to compensate for this determination.

Broadcast Sound

A journalist on location is doing the voiceover for some footage for a documentary about war. He is shouting because the noise level is high and he is talking over the background music. This is live broadcast so he can't fix it in the mix later. He is the mixing engineer, as is so often the case for location reporting, so he sets the mixer level for the voice relative to the background music by looking at the PE meter on the voice channel. A thousand miles away at home, a million TV sets show PE warning lights and the PEC seamlessly corrects the error so that the voice-over signal is clearly audible. No complaints are received by the broadcaster. The system of the present invention is therefore able to provide a visual representation of error levels. Consequently, a user of the system can manually adjust levels based on the representation of error levels.

Audiophile Orchestral Music Reproduction

A group of world-leading musicians assembles in a far-flung temple, famous for its incredible acoustics. They have brought several million dollars' worth of period instruments and collectively they hold around a hundred years of musical experience. The sound they make is very important to them. In performance, the music has been carefully tailored to suit the acoustics and the atmosphere, so the reproduction cannot be an abstract representation of the sound, but must be the actual, absolute pressure signal. For this reason PEC correction is not permitted by the authors, but OEC must be used to recreate the true SPL. In other words, the audio format of the present invention allows for improved accuracy of sound reproduction.

Music Performance

The conductor of an orchestra controls the performance and balance of each musician to get the perfect sound at his location. There is a section in the piece where complex interactions between instruments and the room cause undesirable masking affects at some audience locations, but not for the conductor. When this occurs it triggers a PE warning, alerting the conductor to the problem, who is then able to adapt the performance to minimise its affect.

Music Production a) Robustness with Listening Conditions

A music producer is aware that PEs are introduced when a recording is reproduced on different sound systems, and, before deciding on a final mix, he would like an estimate of the magnitude of these potential effects. Using a set of loudspeaker, room and environmental models, a perceptual robustness meter (PRM) gives him a measure of how robust the mix is to changes in the listening conditions i.e. if the RMS playback level is greater than 100 dB SPL the perceived loudness of the vocals will increase by 20% compared to the rest of the instruments in the mix, or if the noise level is greater than 50 dB SPL the perceived loudness of the guitar will drop by 50% etc. The producer can then make an informed decision whether to modify the mix for robustness.

A system that uses the PE and PEC modules to automatically make mixes more robust is also proposed. The producer can define, for a given mix, a set of PEs that can be introduced by the automatic robustness system (smaller tolerances restrict the changes that can be made). The system then searches the parameter space, using the loudspeaker, room and environmental models discussed above, to make changes to the mix such that robustness is increased. This system can also be used to automatically produce a range of mixes with different robustness characteristics for different reproduction situations. For example, a reproduction on a high quality sound system will likely require a less robust mix than a reproduction on a small kitchen radio.

b) Perceptual Production Controls

When producing a piece of music, the individual sounds interact on a perceptual level. For example, if a vocal signal is set at a specific level it has a certain objective intensity and perceptual loudness. If another signal is added, for example a guitar, the objective intensity of the vocal will be unchanged, but its perceived loudness will decrease due to masking. Balancing such interactions is part of the production process. PE and PEC can be integrated into production tools to accommodate these effects for an arbitrary number of perceptual features. For example, the vocal signal is set at a certain SPL and some perceptual features are locked, for example its loudness, within an allowable PE range. When the guitar signal is added there are two options: 1) PEC is inactive and the guitar is prevented from being added unless it is modified in some way to reduce masking interaction so that vocal loudness is preserved, 2) PEC is active and my mixing desk automatically modifies properties of either the guitar signal, the vocal signal or both signals to preserve the perceptual loudness of the vocals (current tools exist which make the vocal signal ride the rest of the mix by a given dB amount but this is an objective metric in the voltage domain).

Hearing Impairment

In all cases described above the standard auditory model may be substituted for a hearing-impaired auditory model. In this case the hearing-impaired user may be informed of PE, or if PEC is activated this may be applied to correct the error. Any uncorrectable error will be displayed. Furthermore, a hearing-impaired music producer may engage PEC (in his monitoring system) so that the features of his work, ultimately perceived by a non-impaired listener, will be consistent with his intentions and not limited by his impairment. The PE estimated by his monitoring system will then inform him if his impairment is affecting his work in a manner that is not correctable (i.e. the PE warning informs him that he risks making inadvertent or unintentional changes to the sound quality of the signal which he cannot perceive due to his hearing impairment). Hence, the auditory model may comprise a sub-model of the recording engineer's hearing impairment. For example, an audiogram of the engineer may be utilised within the auditory model.

Sound System Certification

Sound systems used for reproduction include cinema theatres, live music venues, production studios, home theatres and automotive audio. These systems introduce OEs and PEs due to sound system and room acoustic properties e.g. loudspeaker response and reverberation. Presently the THX system provides an objective certification of sound reproduction quality e.g. cinema and home theatre. This system is replaced according to the format and error estimation system described above i.e. one that uses PEs and well as OEs.

It will be appreciated that in alternative arrangements a system may pre-produce audio signals for specific systems. For example, a system may be provided that takes the original recording and then produces a "pre-corrected" mix for a specific system. For example, a mix could be provided for being played on headphones thereby predicting the expected listening conditions. Other mixes could be provided, for example, for use on a home-stereo or disco.

The various methods described above may be implemented by a computer program. The computer program may include computer code arranged to instruct a computer to perform the functions of one or more of the various methods described above. The computer program and/or the code for performing such methods may be provided to an apparatus, such as a computer, on a computer readable medium or computer program product. The computer readable medium could be, for example, an electronic, magnetic, optical, electromagnetic, infrared, or semiconductor system, or a propagation medium for data transmission, for example for downloading the code over the Internet. Alternatively, the computer readable medium could take the form of a physical computer readable medium such as semiconductor or solid state memory, magnetic tape, a removable computer diskette, a random access memory (RAM), a read-only memory (ROM), a rigid magnetic disc, and an optical disk, such as a CD-ROM, CD-R/W or DVD.

An apparatus such as a computer may be configured in accordance with such code to perform one or more processes in accordance with the various methods discussed herein. Such an apparatus may take the form of a data processing system. Such a data processing system may be a distributed system. For example, such a data processing system may be distributed across a network.

In some embodiments, any suitable computer readable media can be used for storing instructions for performing the functions and/or processes described herein. For example, in some embodiments, computer readable media can be transitory or non-transitory. For example, non-transitory computer readable media can include media such as magnetic media (such as hard disks, floppy disks, etc.), optical media (such as compact discs, digital video discs, Blu-ray discs, etc.), semiconductor media (such as flash memory, electrically programmable read only memory (EPROM), electrically erasable programmable read only memory (EEPROM), etc.), any suitable media that is not fleeting or devoid of any semblance of permanence during transmission, and/or any suitable tangible media. As another example, transitory computer readable media can include signals on networks, in wires, conductors, optical fibers, circuits, any suitable media that is fleeting and devoid of any semblance of permanence during transmission, and/or any suitable intangible media.

Although the invention has been described and illustrated in the foregoing illustrative embodiments, it is understood that the present disclosure has been made only by way of example, and that numerous changes in the details of implementation of the invention can be made without departing from the spirit and scope of the invention, which is limited only by the claims that follow. Features of the disclosed embodiments can be combined and rearranged in various ways.

What is claimed is:

1. A method for obtaining an audio signal and information relating to the recording conditions of the audio signal, the method comprising:

obtaining an audio signal, wherein the audio signal is a voltage signal representation of sound, the voltage signal having been converted from a pressure signal;

obtaining information indicative of at least one objective feature and/or at least one perceptual feature associated with the conversion of the pressure signal into the audio signal in the form of a voltage signal representation; and storing the audio signal, the information indicative of objective features and/or perceptual features, and information identifying a relationship between the audio signal and the information indicative of the at least one objective feature and/or the at least one perceptual feature, wherein the information indicative of the at least one objective feature and/or the at least one perceptual feature comprises the at least one objective feature and/or the at least one perceptual feature, and wherein the at least one objective feature is extracted from absolute pressure signals of the audio signal.

* * * * *